United States Patent [19]

Kosik, Sr. et al.

[11] Patent Number: 4,919,331

[45] **Date of Patent: * Apr. 24, 1990**

[54] SNOW MAKING APPARATUS AND METHOD FOR MAKING SNOW

[75] Inventors: Joseph F. Kosik, Sr., Rochester; Bruce M. Firestone, Grand Blanc, both of Mich.

[73] Assignee: Mt. Holly, Inc., Holly, Mich.

[ * ] Notice: The portion of the term of this patent subsequent to Mar. 21, 2006 has been disclaimed.

[21] Appl. No.: 323,303

[22] Filed: Mar. 14, 1989

Related U.S. Application Data

[63] Continuation of Ser. No. 74,547, Jul. 17, 1987, Pat. No. 4,813,598.

[51] Int. Cl.[5] ..... A01G 15/00

[52] U.S. Cl. ..... 239/2.2; 239/14.2; 239/132.1; 239/426; 239/559

[58] Field of Search ..... 239/2.2, 14.2, 110, 239/132.1, 418, 426, 559

[56] References Cited

U.S. PATENT DOCUMENTS

| | | | |
|---|---|---|---|
| 966,704 | 8/1910 | Pickles | 239/418 |
| 3,945,567 | 3/1976 | Rambach | 239/14.2 |
| 3,948,442 | 4/1976 | Dewey | 239/2.2 |
| 3,979,061 | 9/1976 | Kircher | 239/2.2 |
| 4,105,161 | 8/1978 | Kircher et al. | 239/14.2 |
| 4,214,700 | 7/1980 | Vanderkelen et al. | 239/14.2 |
| 4,222,519 | 9/1980 | Kircher et al. | 239/14.2 |
| 4,413,784 | 11/1983 | Dea | 239/426 |
| 4,493,457 | 1/1985 | Dilworth et al. | 239/14.2 |
| 4,573,636 | 3/1986 | Dilworth et al. | 239/2.2 |
| 4,682,729 | 7/1987 | Doman et al. | 239/2.2 |

OTHER PUBLICATIONS

Hedco, Inc., "Hedco Snow The Quiet Economy Blizzard", pp. 1-8, received 7/1975.

*Primary Examiner*—Andres Kashnikow
*Assistant Examiner*—Karen B. Merritt
*Attorney, Agent, or Firm*—Krass & Young

[57] ABSTRACT

Snow making apparatus includes a blower for establishing a high volume air flow and a nucleator disposed in the air flow for generating a spray of frozen nuclei. A plurality of water injection nozzles are disposed substantially within and encircling substantially all of the air flow and are selectively actuatable to inject the spray of water into the air stream. Freezing of this spray is initiated by the nuclei at a point remote from the apparatus so as to produce snow.

12 Claims, 3 Drawing Sheets

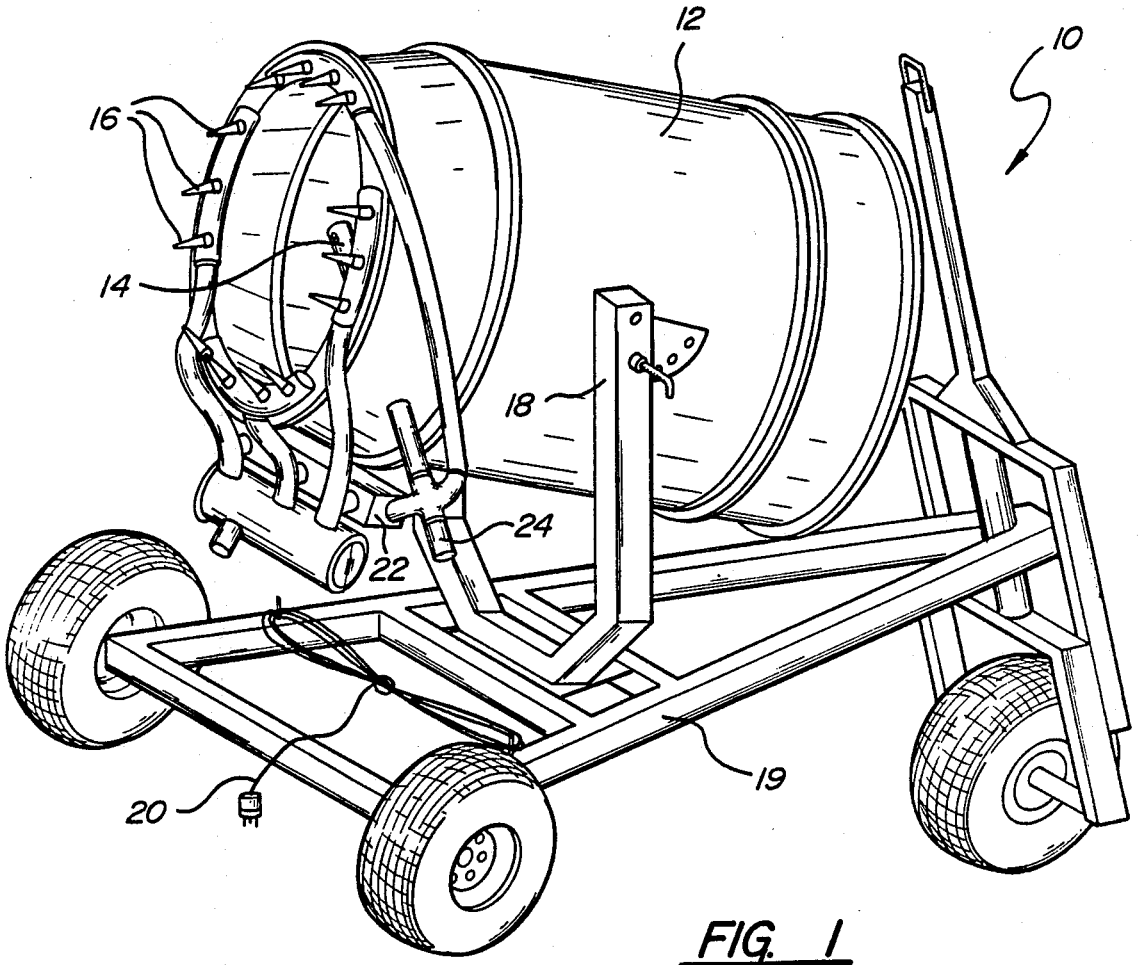
FIG. 1
FIG. 2
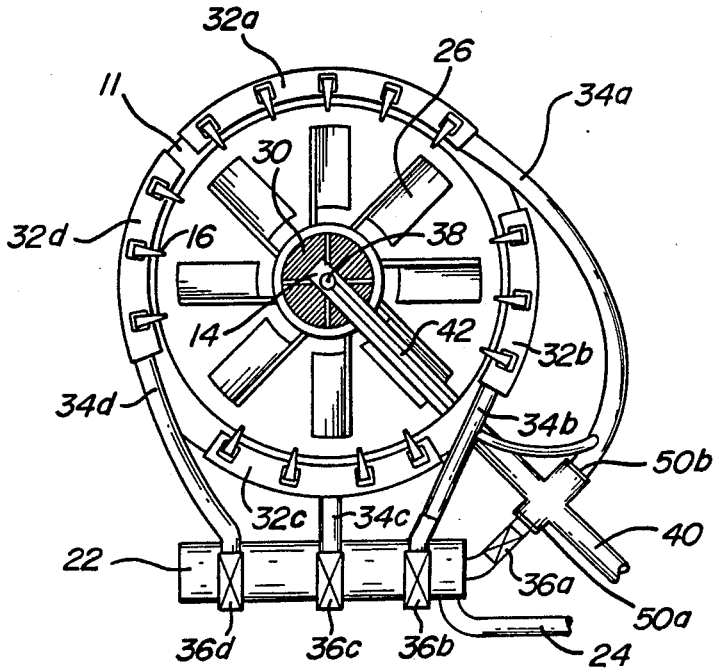

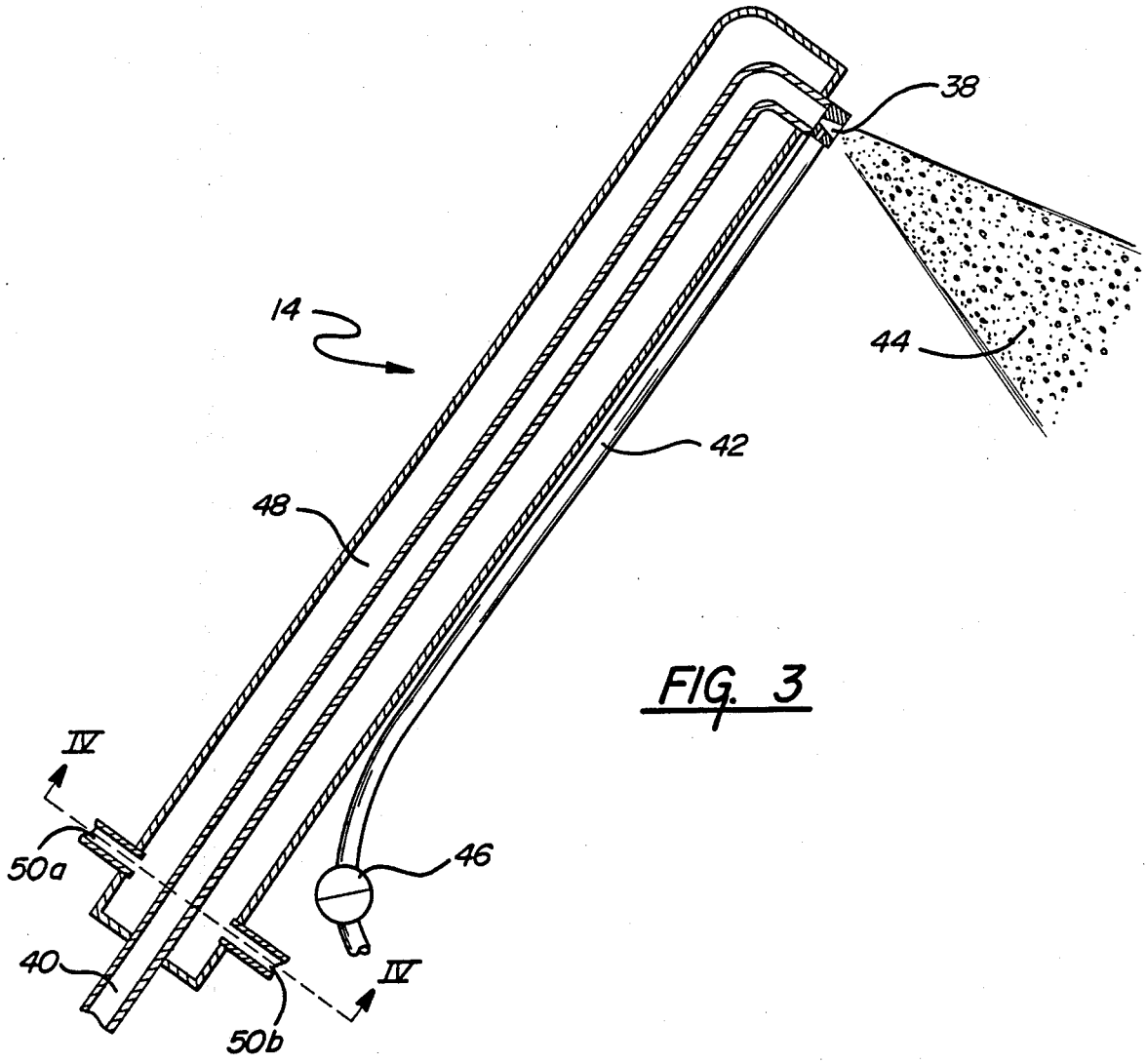
FIG. 3
FIG. 4
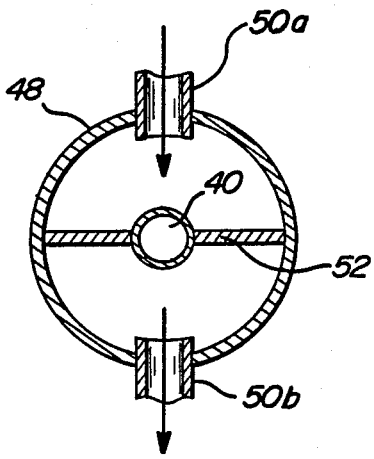

FIG. 5
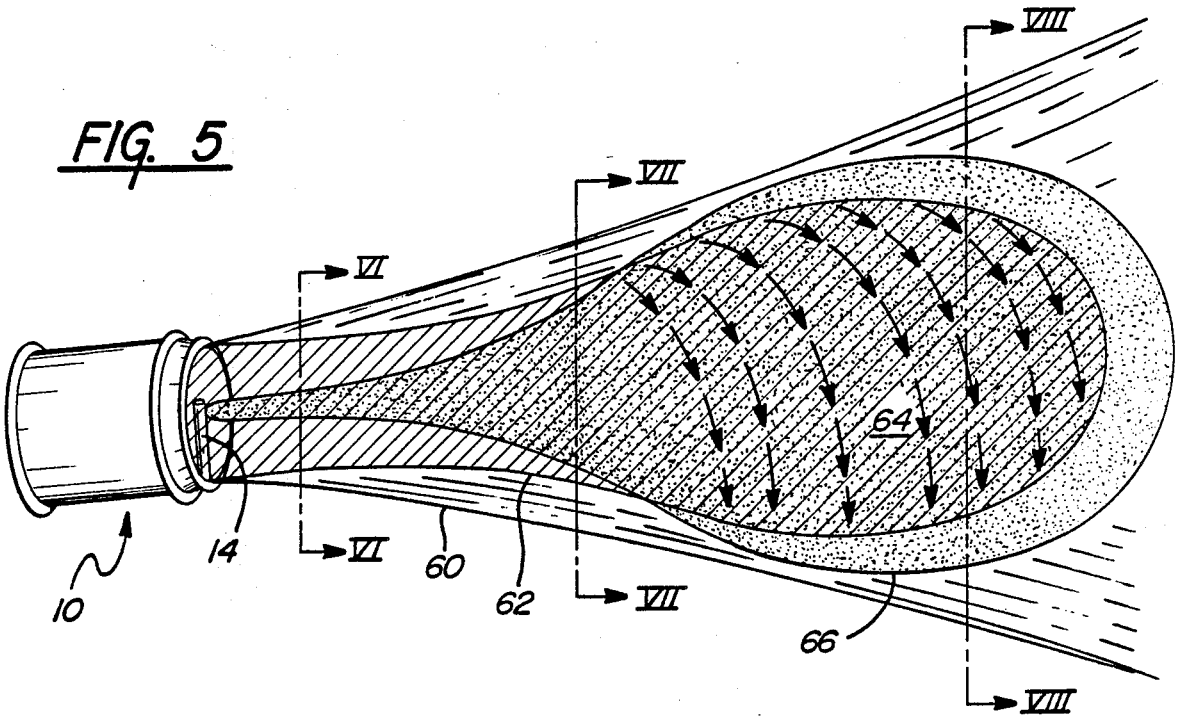
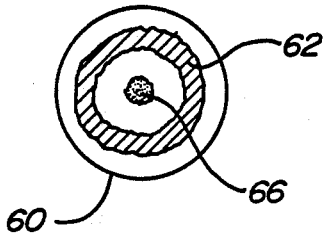
FIG. 6
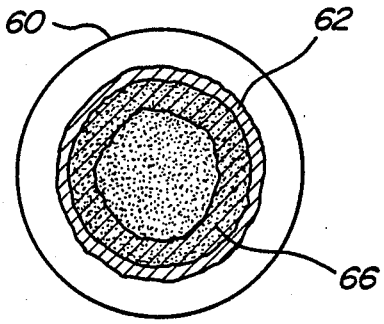
FIG. 7
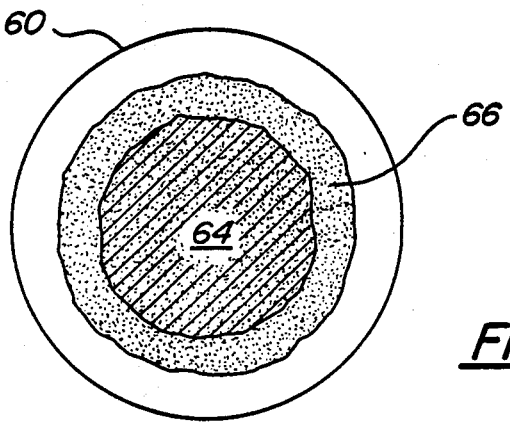
FIG. 8

SNOW MAKING APPARATUS AND METHOD FOR MAKING SNOW

This application is a continuation of U.S. Ser. No. 074,547, filed July 17, 1987, now U.S. Pat. No. 4,813,598.

FIELD OF THE INVENTION

This invention relates generally to artificial snow and in particular to a method and apparatus for manufacturing high quality artificial snow at a low cost.

BACKGROUND OF THE INVENTION

Snow sports such as skiing, sledding and the like are enjoying an ever increasing popularity. This has resulted in an increase in business of winter sports facilities as well as an increased demand for snow covered areas for such facilities. Natural snow is often unpredictably available and frequently in short supply. Increasingly, winter sports facilities are turning to the use of artificial snow-making machinery in order to supplement naturally occurring snow and to extend the sports season. Even in areas where high volumes of naturally occurring snow are present, greater use is being made of artificial snow-making machinery because large numbers of skiers and the like tend to erode snow from slopes at a rate greater than it can be replaced by natural falls.

It has also been found that in many instances artificially made snow is superior to natural snow in terms of wear and groomability. Natural snow tends to be very fine grained and to compact into a solid mass, whereas artificial snow is generally coarser grained material which does not compact but rather allows for drainage of melt-water therethrough and which may be readily groomed by appropriate machinery to restore the natural loft thereto.

For these reasons, artificial snow-making machinery is becoming a standard operational item for skiing, sledding and tobogganing facilities. In general artificial snow is manufactured by directing a stream of moisture bearing air into a freezing or near freezing atmosphere. The earliest snow-making equipment comprised nothing more than a spray nozzle projecting a stream of compressed air and water into the atmosphere. A combination of cold atmospheric conditions and expansive cooling of the air froze the water spray into snow particles. Such equipment is simple in design and easy to operate however its performance is less than adequate. Snow made by the compressed air gun method tends to be very fine grained and prone to compact into an ice-like mass not amenable to grooming or drainage of melt-water; furthermore, such snow does not wear well.

In addition to poor snow quality, the air gun technology is limited by its relative energy inefficiency. Large amounts of compressed air are needed to manufacture snow by this method and such volumes of air are expensive to produce. A typical compressed air gun may consume 500 to 1,000 CFM of air. A general rule of thumb is that it takes approximately 100 horsepower to produce 300 CFM of compressed air; accordingly, it will be appreciated that a typical compressed air gun consumes over 200 horsepower in its operation, necessitating large compressor-motor combinations.

A more recent approach toward the manufacture of artificial snow involves the use of a large fan or blower in conjunction with a water spray. The blower produces a relatively high volume flow of air at pressures only slightly above atmospheric. A spray of water is injected into the stream of air and typically a spray of ice crystal nuclei are also injected so as to seed the moisture laden stream to produce the snow. Such equipment is generally capable of producing high volumes of snow at costs less than those associated with operation of a compressed air gun. While such blower-type equipment is superior in terms of efficiency, problems of control are more critical. For example, proper control of the relative volume of water and air must be maintained. If the amount of water is too low, the volume of snow produced by the machine and hence its efficiency will fall. If the volume of water is too high, not all of the water will be converted to snow and hence the machine will essentially produce rain thereby wetting the previously produced snow and rendering it unusable. The proper volumes of water and air required for most efficient operation will vary as atmospheric conditions vary thereby necessitating frequent adjustment of such blower-type equipment.

Many approaches have been developed to combining water and air in blower-type snow-making equipment in an attempt to secure a wide latitude of operational parameters so as to produce the highest volume of snow at the lowest cost. Additionally, it is desirable that such equipment also produce a high quality of snow.

High quality snow generally may be characterized as having a coarse granular structure which is not prone to compaction so as to allow for a ready draining of melt-water therethrough and so as to provide for easy grooming to restore the loft thereof.

One early approach to the fabrication of blower-type snow-making equipment is represented by U.S. Pat. No. 3,979,061 in which a plurality of nozzles are disposed externally of a stream of air so as to spray high pressure water into that stream. Nucleation is accomplished by impinging a high pressure, low volume stream of air into the water stream so as to initiate freezing proximate its point of introduction. This apparatus was hard to keep in adjustment and water droplets tended to fall out of the air stream prior to crystalization so as to form ice patches and wet regions on previously deposited snow. Another early approach is detailed in U.S. Pat. No. 3,948,442 which teaches the use of a high volume air blower having a pulsed spray of water. The apparatus of the '442 patent utilizes a plurality of ice crystal generators located along the periphery of a blower to seed the air stream proximate the apparatus. This apparatus produces snow of moderate quality but requires a delicate control of the compressor utilized to generate the pulsed water flow and further necessitates the use of filtered water if problems of clogging are to be avoided.

U.S. Pat. No. 4,493,457 discloses the use of a blower having water spray nozzles arrayed around portions of its perimeter so as to spray water into the center of the air stream from points which are substantially above and substantially below that stream. This apparatus further includes a venturi-type seeder disposed within the center of the air stream so as to nucleate the spray at that point. U.S. Pat. No. 4,573,636 discloses an apparatus which is substantially similar to that of the '457 patent except that it further includes an air directing shroud disposed about the blower housing so as to further remove the spray nozzles from the air stream. Apparatus of this type produce relatively fine grained nuclei and are relatively difficult to keep tuned for optimum performance as atmospheric conditions change.

Typically the spray nozzles must be changed as the temperature falls below 20° F. if optimum quality snow and maximum efficiency are to be maintained.

U.S Pat. Nos. 4,105,161 and 4,222,519 describe a blower-type method and apparatus for snowmaking. As disclosed therein, the stream of air from the blower is deflected upward by a deflector plate. A nucleator is mounted in the shadow of the plate and adapted to project nuclei into the air stream from a point outside that stream. Additionally, a bank of nozzles is mounted above the air stream encircling only approximately the upper fourth thereof. These nozzles direct the spray of water into the air stream from a point outside that stream. This apparatus also requires precise control of operational parameters to assure maximum efficiency.

All of the foregoing apparatus nucleate their water spray proximate the apparatus. In such an arrangement, dripping can frequently occur because the water spray is not finely dispersed, nor has it had a chance to cool since its introduction. It should be appreciated in the foregoing then that there is a need for snow-making apparatus method capable of delivering high volumes of quality snow at economical costs, without producing any dripping. Additionally, such apparatus should be simple to operate over a range of varying climatic conditions without the necessity for repeated readjustments. Such apparatus should also not be prone to freeze up or other weather induced difficulties. The present invention provides such a method and apparatus.

As will be described in greater detail hereinbelow, the snow-making apparatus of the present invention includes water spray nozzles and a nucleator which are both disposed within a high volume air stream so as to obtain maximum dispersion and cooling of water before contact with the nuclei. The present invention thus is adapted to efficiently manufacture and widely disperse high volumes of high quality snow under a variety of climatic conditions. Furthermore, the nucleator and nozzles of the apparatus are designed so as to prevent freezing of water therein.

As will be described in greater detail herein below, the nucleator of the present invention is capable of producing nuclei approximately four times larger in size than those produced by previously available equipment. As a consequence of the larger and more efficient nucleation, the present apparatus produces snow having superior qualities. Snow produced in accord with the present invention has a granular structure which is resistant to melting and wearing and well adapted to promote drainage of melt-water therethrough. The granular structure of the snow prevents compaction permitting ready grooming of the snow into a high quality surface for skiing. These and other advantages of the present invention will be readily apparent from the drawings, descriptions and claims which follow.

BRIEF DESCRIPTION OF THE INVENTION

There is disclosed herein a snow-making apparatus comprising a blower adapted to provide a high volume stream of air, with a nucleator disposed proximate the center of the air stream. The nucleator comprises an air nozzle having an orifice adapted to discharge a high pressure flow of air in a direction parallel to the stream of air and a water inlet adapted to impinge a stream of water into the high pressure air flow proximate that orifice so as to project ice crystals into the stream of air at high velocity. The snow-making apparatus further includes a plurality of water injection nozzles disposed substantially within and encircling substantially all of the stream of air. The nozzles are selectively actuatable to inject the spray of water into the air stream.

In one embodiment, the nozzles are disposed so as to initially introduce the spray of water into the peripheral portion of the air stream and the nucleator is disposed so as to initially project the ice crystals into central portions of the air stream so that substantial contact between the crystals and the water spray does not occur within twenty feet of the nucleator. The nozzles may be disposed so as to form a cloud of finely dispersed water beginning at a point greater than thirty feet from the nucleator, and the nucleator is adapted to operate in conjunction with the blower so as to provide a spray of ice crystals enveloping the cloud.

In another embodiment, the water injection nozzles are arranged in a plurality of groups each connected to a common water supply manifold and being capable of being separately actuatable so as to control the amount of water injected into the air stream. The nozzles may further have drain means associated therewith for draining residual water from them when that particular group is not actuated so as to prevent freezing. In one specific embodiment, the nozzles are arranged in four groups, each group encircling approximately one-fourth of the air stream.

The water inlet of the nucleator may be advantageously adapted to impinge a stream of water into the high pressure air flow at an approximately 90° angle at a point immediately after its discharge from the orifice. The orifice is supplied with air at a pressure higher than the pressure in the stream of water by the compressed air line which may have that portion thereof most proximate the orifice water jacketed so as to prevent freezing of moisture collected therein. The water from the water jacket may be circulated to the water injection nozzles. The nucleator is typically adapted to discharge a 25–100 CFM flow of high pressure air therefrom while the blower may be adapted to provide an approximately 25,000–50,000 CFM stream of air at substantially atmospheric pressure.

The present invention also includes a method of making snow including the steps of providing a high volume stream of air at substantially atmospheric pressure, providing a nucleator adapted to: (1) discharge a high pressure flow of air parallel to the high volume stream of air, and (2) impinge a stream of water into the high pressure flow of air; disposing the nucleator in approximately the center of the high volume stream of air so as to initially inject ice crystals into the central portion of the stream and disposing a plurality of water injection nozzles substantially within the high volume stream of air, so as to initially inject a spray of water into the periphery of the stream, so as to initiate freezing thereof at a point greater than twenty feet from the nucleator orifice.

BRIEF DESCRIPTION OF THE DRAWINGS

FIG. 1 is a perspective view of a snow-making machine structured in accord with the principles of the present invention;

FIG. 2 is a front elevational view of the snow-making machine of FIG. 1 better illustrating the nucleator and water nozzles thereof;

FIG. 3 is a cross-sectional view of a nucleator structured in accord with the principles of the present invention; and FIG. 4 is a cross-sectional view of the nucleator of FIG. 3 better illustrating the water inlet, water outlet and baffle thereof;

FIG. 5 is a depiction of the flows of air, water spray and ice crystal nuclei emanating from an apparatus of the present invention; and FIGS. 6, 7 and 8 are cross-sectional views taken along the indicated lines in the flows of FIG. 5.

DETAILED DESCRIPTION OF THE INVENTION

Referring now to FIG. 1, there is shown a perspective view of a snow-making apparatus 10 structured in accord with the principles of the instant invention. The apparatus is comprised of a blower unit 12 having a nucleator 14 and a plurality of water spray nozzles 16 mounted thereon. The snow-making machine further includes a mounting yoke 18 for positionably supporting the blower unit 12 upon a wheeled carriage 19.

Housed within the blower unit 12 is a high volume fan powered through an electrical connection 20. As shown, the nozzles 16 are mounted in groups connected to a water supply manifold 22 having a water connection 24 communicating therewith.

Referring now to FIG. 2, there is shown in better detail, a front elevational view of a portion of the apparatus of the present invention, illustrating the water and air supply systems thereof. As depicted in the figure, the apparatus includes the blower unit 12 having a fan 26 driven by a motor 30 and contained within a housing 11. The fan 26 and the blower housing 11 cooperate to provide a high volume stream of air at pressures only slightly above atmospheric.

The fan 26 may be of any type well-known to those skilled in the art and capable of delivering a sufficient volume of air. One typical fan which may be employed turns at approximately 1,795 rpm and produces an air flow of approximately 40,000 CFM. Such a fan is typically powered by a 20 horsepower electric motor and consumes 25 amps of electrical power. Obviously, other fans may be similarly employed and it should be noted that while the fan 26 illustrated in FIG. 2 is a bladed turbine-type fan, other air moving devices such as squirrel cage blowers and the like may be readily adapted for use in the instant invention.

Disposed within the air stream provided by the fan 26 are a plurality of spray nozzles 16. These nozzles are disposed substantially within, and encircling substantially all of the stream of air provided by the fan 26, and are oriented so as to initially direct the spray of water only into the peripheral portions of the air stream. By so directing the spray of water, contact with ice crystal nuclei is substantially prevented at distances of less than ten to twenty feet from the apparatus. This is in contradistinction to previously employed snow-making machinery which utilize nozzles disposed outside of the air stream and oriented so as to project a spray of water thereinto for contact with the nuclei proximate the apparatus. By disposing the nozzles within the air stream additional cooling of both the nozzle and the water spray is obtained from the air flow and a finer and farther dispersion of the water results thereby allowing for use of higher volumes of water without causing water droplet formation in the final snow stream, as will be described in greater detail hereinbelow.

There are a wide variety of spray nozzles which may be employed, the only criterion being that the nozzles be capable of delivering a fine mist of fog of water vapor without significant inclusion of larger droplets. It is also desirable that the nozzles not be prone to clogging from debris which may be present in the water supply. Elimination of clogging is significant because snow-making machinery is frequently utilized at sites remote from purified city water supplies, or in many instances the volume of water required for snow making is sufficiently high so that it is uneconomical to use drinking quality water. Consequently it is desirable to utilize unpurified lake, pond or well water in such snow-making equipment. One particular nozzle which is well suited for use with the present invention is a fog nozzle manufactured by the Bete Spray System Corporation.

It will be noted from the figure that the nozzles 16 are grouped into four separate units **32*a*–32*d* arranged about the circumference of the blower housing 11. The first group 32*a* includes five nozzles and is disposed within the topmost portion of the air stream. This is the primary group of nozzles which is always employed in snow making. The first group of nozzles 32*a* communicates with a water supply manifold 22 by means of a supply pipe 34*a*. The second and fourth groups of nozzles 32*b*, 32*d* each include three nozzles and are disposed within the sides of the air stream and each communicates with the water manifold 22 by a water line 34*b*, 34*d*. A third group of nozzles 32*c* is located in the bottom portion of the air stream and includes four nozzles and communicates with the manifold 22 by the water supply line 34*c*. As weather conditions get colder nozzle groups 32*b*, 32*c* and 32*d*** may be activated so as to increase the capacity of the snow-making apparatus.

It will be noted that each of the water supply lines **34*a*–34*d* has associated therewith a controller 36*a*–36*d*. This controller, which may be a manual controller such as a set of valves, or an electrically operated controller such as a solenoid valve is adapted to initiate supply of water from the manifold 22 to the water lines 34 supplying the groups of nozzles. The controllers 36*a*–36*d* may also include provision for automatically draining the particular water line 34 associated therewith when water supply is terminated. This feature of the present invention is important insofar as it prevents icing of the water lines when a group of nozzles is deactivated. The water supply manifold 22 has a water supply line 24** associated therewith and adapted to be connected to a high volume source of water, and may also include an automatic drain to remove water therefrom, when the unit is not operational.

Also visible in the figure is a nucleator 14 disposed so as to extend into the center of the air stream provided by the fan 26. It is this nucleator 14 which seeds the moisture-laden air stream so as to initiate crystalization of snow therefrom. The nucleator, which will be described in greater detail hereinbelow, is disposed so as to discharge a high pressure flow of air in a direction generally parallel to the stream of air produced by the fan and toward this end includes a nozzle or an orifice 38 therein. The orifice 38 is provided with high pressure compressed air via an air line 40 adapted for connection to a high pressure source of air.

The nucleator 14 further includes a water inlet 42 adapted to impinge a stream of water into the high pressure air flow proximate the orifice 38. As shown, the water inlet 42 is a relatively small diameter tube communicating with the main water supply line **34*a***. It is generally preferred that the water stream impinge the high pressure flow of air close to the orifice, but on the outside thereof, so that any mixing of air and water prior to discharge from the orifice is avoided. Also, it is generally preferred that the flow of the air be higher than that of the water stream. In this instance, the air will then "siphon" water from the line. This unique combination of feature has been found to produce high quality nuclei as well as eliminating icing of the nucleator orifice, and water inlet.

In operation, water is supplied to the manifold 22 by the water supply line 24, compressed air is supplied to the nucleator 14 by the air line 40 and the fan 26 is activated so as to provide a high volume flow of air. Depending upon temperature, relative humidity and other atmospheric conditions anywhere from one to four of the nozzle groups 32*a*–32*d* are activated. In colder and dryer weather more water flow is desirable and consequently all of the groups may be activated, whereas in temperatures nearer to freezing it may be desirable to only activate the upper group 32*a* of nozzles. In accord with the number of groups to be activated, the appropriate controllers 36 are operated so as to provide water to the selected nozzle groups 32. Water is also provided to the nucleator via the water inlet 42 so as to initiate the formation of nuclei.

The nucleator of the present invention is quite efficient over a wide range of operational parameters and consequently needs little adjustment. Typically, the water flowing into the nucleator via the inlet 42 is approximately 0.5 gallon per minute, however, if desired the amount of water may be controlled with a valve (not shown in this drawing) so as to obtain optimum nuclei formation. The flow of compressed air through the orifice 38 is typically adjusted so as to maintain an approximately 25–100 CFM flow of air and water from the inlet 42 is impinged onto this stream; it should be noted that this is approximately 5–10% of the air flow through compressed air gun type apparatus.

The combination of the expanding compressed air and ambient conditions serve to finely disperse the stream of water from the inlet 42 and freeze that dispersed stream into nuclei. As mentioned previously, nuclei formed by a nucleator of this design are typically two to four times larger than those formed in prior art nucleators, being on the order of 0.1 to 0.5 millimeters in size.

The nozzles 16 are disposed within the stream of air and provide a spray of finely dispersed water thereinto. The high volume flow of air serves to rapidly chill the water and contact with nuclei at a point remote from the nucleator 14 initiates freezing of that chilled water so as to produce snow crystals which are carried aloft by the high volume flow of air. When atmospheric conditions change additional groups of nozzles may be activated or deactivated by use of the controllers 36 associated therewith. When terminating water supply to a nozzle group 32 it is desirable to drain both the nozzle group 32 and the water supply line 34 communicating therewith and such draining may be accomplished as mentioned previously by use of a drain fitting in combination with the controller 36. The manifold 22 may also have associated therewith a drain fitting so as to completely remove residual water from the system when it is inactivated so as to prevent freeze-up thereof.

Because of the quality of the nuclei produced by the nucleator 14 and because of the particular dispersal of water and nuclei resultant from the configuration and placement of the nozzle groups 32, and nucleator 14, the apparatus of the present invention manufactures high volumes of high quality snow and furthermore produces such snow at temperatures near and even slightly above freezing as well as at lower temperatures. As mentioned previously, the snow produced through the use of the present invention wears well, is readily regroomed and provides a high quality skiing surface.

The apparatus of FIGS. 1 and 2 is merely illustrative of one embodiment of snow-making machines structured in accord with the principles of the instant invention. Obviously, various modifications may be made thereto in keeping with the spirit of the present invention. As shown in FIG. 2, the water inlet 42 is connected to the main valve group supply line 34*a* so that water is supplied thereto whenever the line is activated. In some instances it may be desirable to separately supply the water inlet line 42 from the manifold 22 or from other such supply so that operation of the nucleator may be initiated well prior to the spraying of water from the nozzle group 32*a*. By utilizing such an arrangement, the nucleator may be optimized for peak performance in the absence of any additional spray. Other such modifications may also be made. For example, a number of nozzles 16 may be increased or decreased as may be the number of nozzle groups 32. Additional nozzle groups 32 may be added by merely making the presently depicted groups smaller or by adding additional concentric banks of nozzle groups. As previously mentioned various other fans or air moving arrangements may be employed in conjunction herewith, all of such variations being within the scope of the present invention.

Referring now to FIG. 3, there is shown a more detailed, cross-sectional view of a nucleator 14 structured in accord with the principles of the instant invention. As shown the nucleator 14 includes an orifice or nozzle 38 adapted to provide a high volume flow of compressed air. Communicating with the orifice 38 is a compressed air supply line 40 capable of supplying at least 25–100 CFM of air through the orifice 38. A water inlet line 42 is disposed proximate the opening of the orifice 38 so as to direct the fine stream of water into the flow of compressed air. The air flow disrupts the stream of water into a plurality of fine droplets and freezes that water into nuclei which are projected into a generally cone-shaped spray 44. As mentioned previously, the flow-rate of the air is grater than the flow-rate of the water; consequently, the flow of air tends to draw water through the inlet line 42. This siphon action, together with the fact that the inlet line 42 is located exteriorly of the orifice so that water and air do not mix prior to dispersion prevents freeze up of the nucleator. As shown the water inlet line 42 may have associated therewith a control valve 46 for regulating the amount of water flowing therethrough so as to optimize nuclei production.

Compressed air frequently includes moisture therein and such moisture can condense in the air lines, particularly at cool points. Expansion of air at the orifice 38 creates a cooling effect which tends to collect moisture. Such condensate can freeze thereby clogging the air flow through the air line 40 and preventing nuclei formation. When such an event occurs the nucleation process ceases, the water inlet 42 projects unfrozen water into the air stream, water from the nozzle 16 is not nucleated and the snow-making apparatus spews forth a stream of rain. Obviously it is desirable to prevent such clogging of the air line of the nucleator 14. Previous attempts to prevent icing involved electrically heating the nucleator's air lines with heat tape and the like; however, such approaches are frequently unreliable and also consume excess electrical energy.

In accord with the present invention the air line 40 of the nucleator 14 is provided with a water jacket 48 thereabout. Water has a very high latent heat, and the jacket 48 prevents freeze-up of the air line 40. Referring back to FIG. 2, it will be noted that water flowing to the main nozzle group 32*a* flows from the manifold 22, through its controller 36*a* then through the housing of the nucleator at two points 50*a*, 50*b* before reaching the supply line 34*a*. In this manner, water flowing to the main nozzle group 32*a* serves to keep the air line 40 free from freezing. Furthermore, the particular arrangement of the water inlet 42 and orifice 38 presents freezing of those components. In addition to saving on electricity, such an arrangement confers an additional advantage insofar as the water flowing through the water jacket 48 is cooled to some degree prior to being conveyed to the main nozzle group 32*a*.

In order to insure that the water flows throughout the entirety of the jacket 48 it may be advantageous to include an internal baffle system for directing the water. Such a baffle may be configured, as is well known to those of skill in the art so as to direct water from the inlet point 50*a* up through the water jacket 48 to the vicinity of the orifice 38, back down through the jacket 48 and out the exit point 50*b*.

Referring now to FIG. 4 there is a shown a cross-sectional view of the nucleator of FIG. 3 taken along line IV—IV and illustrating the inlet 50*a*, outlet 50*b*, air line 40, water jacket 48 and internal baffle 52. As depicted, the baffle 52 divides the interior of the water jacket into two compartments, and extends from the base of the jacket to a point proximate the upper limit of the jacket so as to leave a communication between the two compartments proximate the orifice 38. Water flows in from the inlet 50*a*, up through the first portion of the jacket and back down through the second portion to exit via the outlet 50*b*. The latent heat of a body of water, even a body of water at nearing freezing temperature is very high; consequently an arrangement such as depicted will very adequately keep both the orifice 38 and the air line 40 from freezing up while not significantly interfering with nuclei formation.

It should be kept in mind that numerous variations of nucleator may be fabricated in accord with the general principles disclosed herein. For example, the water inlet 42 may be disposed interiorly of the air line 40 proximate the orifice 38 so as to discharge the stream of water into the flow of compressed air. Also, while the stream of water from the inlet 42 is shown as impinging the stream of compressed air at approximately right angles, other arrangements may be employed, for example the stream of water may impinge the high pressure air flow at an oblique angle or it may be projected along in the direction of the air flow. Similarly, the water jacket may take forms other than as shown. For example, the jacket may comprise a helical, tubular member substantially wrapped around the air line 40; likewise, the water jacket may include other types of baffle designs, the main criterion being that a flow of water is utilized to prevent nucleator icing.

The combination of nucleator and nozzle positions employed in the snow-making machine of the present invention result in a unique dispersion of water spray and ice crystal nuclei, which dispersion is responsible for the superior performance of the apparatus. As mentioned previously, apparatus structured in accordance with the principles of the present invention produce a high quality, dry snow without significant dripping of water from the air stream. The apparatus operate at higher temperatures than do prior art snow-making machinery and are capable of producing a larger volume of snow from a given amount of water.

Referring now to FIG. 5, there is shown a representation of the flow of air, water spray and ice crystal nuclei produced by an apparatus of the present invention. As depicted a snow-making apparatus 10, generally similar to those previously described, and shown here in simplified stylistic form, projects a stream of air, indicated by the solid outline, from the fan barrel thereof. This stream of air 60 generally spreads out as it leaves the snow-making apparatus becoming larger in cross section and lower in velocity.

The nozzles, not shown in this stylistic view, are oriented within the air stream and disposed so as to initially project the spray of water into the peripheral portions of the stream of air 60. The spray of water is indicated by the outline 62 and as may be seen, the spray travels through the air stream 60 for a considerable distance and gradually drifts into the center portions of the air stream so as to form a cloud in a region 64 some distance from the apparatus 10. Movement of the water spray into the central portions of the air stream is accomplished by gravity and frictional drag. Initially, proximate the point of discharge, the air stream 60 and the water spray 62 are moving rapidly with a high forward component to their motion consequently, the water spray 62 will remain close to the periphery of the air stream 60, and be swept along thereby. As the air stream loses velocity and as the water spray loses velocity water droplets will tend to fall from the upper portions of the air stream into the more central portions thereof, as indicated by the plurality of arrows in the region 64. Similarly, water spray in the lower portions of the air stream will diffuse upward to some degree. In this manner a "cloud" of water spray will be created at a point remote from the apparatus 10. It is generally preferred in the present invention that this cloud be formed at a point 50 to 300 feet from the point of discharge.

In the course of traveling in the air stream and dispersing, the water spray becomes further cooled by expansion of the air stream and by contact with ambient air. This cooling prepares the water spray for rapid freezing when nucleated by ice crystals. Furthermore, during the time of travel, the water spray is further atomized into finer droplets so as to increase the efficiency of the snow-making process.

In order to initiate freezing of the water spray, contact with nuclei such as ice crystals is necessary. According to the present invention, conditions of such contact are optimized. In the figure, the spray of ice crystals from the nucleator 14 is indicated by the outline 66 and as is apparent, the spray of ice crystal nuclei is initially projected into the central portions of the air flow. The ice crystal nuclei are generally lighter than the droplets in the water spray and hence are slowed to a greater degree by air friction and thus are more widely dispersed. This phenomenon causes the ice crystals to rapidly fan out so as to form a body which envelops the cloud of water spray thereby assuring that all droplets are nucleated. As is shown in the figure, the stream of ice crystal nuclei do not even begin to contact the water droplets in the spray until a point approximately ten to twenty feet from the nucleator 14 of the apparatus 10.

As mentioned previously, delaying the contact of the nuclei and the water spray greatly enhances the efficiency of the snow-making process. Water in the spray is of necessity at temperatures above freezing when initially discharged. Typically the water is 34–36° F. and if this warm water contacts the ice crystal nuclei it is likely to melt those nuclei and thereby form drops which will fall to the ground and eventually freeze to form a patch of ice. As the water spray travels through the air stream it is cooled by contact with ambient air as well as by expansion of the air stream, and in fact in some instances may be supercooled to temperatures below freezing. Contact of this cold or super cold water with nuclei results in rapid freezing of a hard, dry snow crystal. Also, delaying contact allows for further cooling of the nuclei, thereby improving their efficiency. Thus it will be appreciated that an advantage of the apparatus of the present invention is that contact of nuclei and water spray is significantly delayed as compared to prior art apparatus.

The exact flow of air, ice crystal nuclei and water spray will be better understood by reference to FIGS. 6, 7 and 8, which are cross sections of the stream illustrated in FIG. 5. Referring now to FIG. 6 there is shown a cross section of the stream taken along lines VI—VI, and typical of the stream at a point within several feet of discharge from the apparatus. Illustrated in the cross section is the air stream 60 having proximate to the edges thereof an annular zone 62 in which the water spray is dispersed. The central portion of the air stream 60 has the ice crystal nuclei 66 in a compact region thereof. As the air stream expands, the annular region 62 of water spray and the compact region 66 of ice crystal nuclei both expand.

FIG. 7, taken along lines VII—VII and at a point approximately 10 to 20 feet from the apparatus illustrates this expansion. As is apparent, the annular region of water spray 62 has expanded so as to move in toward the center of the air stream 60. Likewise the region with the nuclei 66 has similarly expanded outward and contact between the nuclei and the water spray is beginning to occur.

FIG. 8 is a cross section taken along line VII—VII at a point between 50 and 300 feet from the apparatus. At this point the water spray has completely expanded so as to form a cloud 64 comprised of cooled water droplets. Likewise, the body of ice crystal nuclei 66 has expanded to form a relatively large region which permeates and envelops the entirety of the cloud of water droplets and projects even further beyond the edges thereof. Nucleation occurs very efficiently in the cloud 64 because of the wide dispersion of water droplets and nuclei, and because of the cooling resultant from such dispersion. Any water droplets which are not nucleated within the cloud 64 must still pass through the enveloping region projecting beyond the cloud and thus are nucleated so as to prevent any dripping of water out of the cloud and onto the newly formed snow surface.

An arrangement of nucleator and water spray nozzles such as illustrated and discussed has not been shown in the prior art; reference to prior art patents cited hereinabove teaches that nuclei and water are contacted very close to the apparatus. Such prior art snow-making machinery typically requires temperatures of 23–24° F. or lower to assure proper operation. In contrast, the apparatus of the present invention efficiently manufactures snow at temperatures exceeding of 28° F. without dripping of unfrozen water therefrom. It has been found that prior art apparatus may waste up to 20–30% of water input thereto in form of drippage whereas the present invention utilizes virtually all of the water applied thereto.

In light of the foregoing it will be appreciated that the drawings, description and discussion included herewith are merely illustrative of particular embodiments of the present invention and not limitations upon the practice thereof. It is the following claims, including all equivalents, which are meant to define the scope of the invention.

We claim:

1. Snow making apparatus comprising:

a blower adapted to provide a high volume stream of air;

a nucleator disposed proximate the center of said air stream, said nucleator comprising an air nozzle having an orifice adapted to discharge a high pressure flow of air in a direction parallel to the stream of air, and a water inlet adapted to impinge a stream of water into said high pressure flow of air proximate the orifice, whereby said nucleator is adapted to project ice crystals at high velocity into central portions of said stream of air; and a water injection nozzle said nozzle selectively actuatable to inject a spray of water into the air stream and oriented so as to initially introduce the spray of water into the peripheral portions of the air stream, so that substantial contact between said crystals and said water does not occur within ten to twenty feet of said nucleator.

2. An apparatus as in claim 1, wherein said nozzle is disposed so as to form a cloud of finely dispersed water beginning at a point greater than twenty feet from the nucleator; and wherein said nucleator is adapted to operate in conjunction with the blower so as to provide a spray of ice crystals enveloping said cloud.

3. An apparatus as in claim 1, wherein the water inlet of the nucleator is adapted to impinge the stream of water into the high pressure flow of air at an approximately 90 degree angle at a point immediately after its discharge from the orifice.

4. An apparatus as in claim 1, wherein said nucleator orifice is supplied with high pressure air by a compressed air line, having that portion thereof disposed most proximate the orifice water jacketed so as to prevent freezing of moisture collected therein.

5. Snow making apparatus comprising:

a blower adapted to provide a high volume stream of air;

a nucleator disposed proximate the center of said air stream, said nucleator comprising an air nozzle having an orifice adapted to discharge a high pressure flow of air in a direction parallel to the stream of air, and a water inlet adapted to impinge a stream of water into said high pressure flow of air proximate the orifice, whereby said nucleator is adapted to project ice crystals at high velocity into said stream of air; and a water injection nozzle, said nozzle selectively actuatable to inject a spray of water into the air stream, wherein said nucleator orifice is supplied with high pressure air by a compressed air line having that portion thereof disposed most proximate the orifice water jacketed so as to prevent freezing of moisture collected therein, and water from said water jacket is circulated to said water injection nozzles.

6. An apparatus as in claim 5, wherein the water inlet in said nucleator is adapted to impinge said stream of water into the flow of air at a point immediately after its discharge from the orifice, and wherein the flow of air is at a higher flow-rate than the stream of water whereby said flow functions to draw water from said inlet and icing of the nucleator is prevented.

7. A nucleator for use in a snow making apparatus, said nucleator being adapted to provide a spray of ice crystals and comprising:

an orifice adapted to discharge a high pressure flow of air;

a compressed air line operatively communicating with said orifice so as to supply compressed air thereto;

a water injector disposed proximate said orifice and adapted to impinge a stream of water into said discharged pressure flow of air, the flow-rate of said stream being less than the flow-rate of said flow of air; and a water jacket surrounding at least that portion of said compressed air line most proximate the orifice, whereby freezing of condensed mixture in the compressed air line is prevented.

8. An apparatus as in claim 7, wherein said water injector is adapted to impinge a stream of water into the high pressure flow of air at an angle of approximately 90 degrees.

9. An apparatus as in claim 7, wherein said orifice is adapted to supply a 25–100 CFM flow of air.

10. A method of making snow, said method comprising:

providing a blower adapted to provide a high volume stream of air;

providing a nucleator, said nucleator adapted to discharge a high pressure flow of air in a direction parallel to the stream of air, and a water inlet adapted to impinge a stream of water into said high pressure flow of air so as to produce a spray of ice crystals;

disposing said nucleator proximate the center of the high volume stream of air, so that said spray of crystals is initially projected into central portions of the stream of air; and injecting a spray of water into the air stream from a nozzle oriented so as to initially inject said spray of water into the periphery of the air stream, so that said spray of ice crystals initially contacts the spray of water at a point at least ten feet from the nucleator so as to initiate freezing thereof.

11. A method as in claim 10, wherein the step of providing a nucleator comprises providing a nucleator having an orifice operatively communicating with a compressed air line, said orifice and air line operative in communication to provide said high pressure flow.

12. A method as in claim 11, including the further step of disposing a water jacket about at least a portion of said air line proximate said orifice, whereby freezing of moisture in said air line is prevented.

* * * * *